United States Patent [19]

Bennett

[11] Patent Number: 5,023,595

[45] Date of Patent: Jun. 11, 1991

[54] MAIL ARRIVAL SIGNAL SYSTEM

[76] Inventor: Charles S. Bennett, P.O. Box 1531, Mercer Island, Wash. 98040

[21] Appl. No.: 316,897

[22] Filed: Feb. 27, 1989

[51] Int. Cl.[5] ..... G08B 13/14; H01H 3/16; B65D 91/00

[52] U.S. Cl. ..... 340/569; 200/61.63; 232/37; 340/539

[58] Field of Search ..... 340/569, 539, 308; 200/61.63, 61.47; 232/35-37

[56] References Cited

U.S. PATENT DOCUMENTS

| | | | |
|---|---|---|---|
| 3,603,952 | 9/1971 | Smith | 340/539 |
| 3,611,333 | 10/1971 | Conigliaro | 340/569 X |
| 3,707,260 | 12/1972 | Gelineau, Sr. et al. | 340/539 X |
| 3,980,996 | 9/1976 | Greenspan et al. | 340/539 |
| 4,101,877 | 7/1978 | Rush | 340/569 |
| 4,154,393 | 5/1979 | Darvishian | 232/36 |
| 4,287,514 | 9/1981 | Wartman et al. | 340/569 |
| 4,520,350 | 5/1985 | Huang | 340/569 |
| 4,633,236 | 12/1986 | Buhl | 340/569 |
| 4,777,474 | 10/1988 | Clayton | 340/539 |
| 4,792,796 | 12/1988 | Bradshaw et al. | 340/539 |
| 4,794,377 | 12/1988 | Benages | 340/569 |
| 4,868,543 | 9/1989 | Binkley | 340/569 |
| 4,872,210 | 10/1989 | Benages | 340/569 |

FOREIGN PATENT DOCUMENTS

| | | | |
|---|---|---|---|
| 507682 | 11/1954 | Canada | 340/569 |

OTHER PUBLICATIONS

"Operating Instructions for Your New Postronic Electronic Mail Detector," QuesTech, A Division of Creative Technologies, Inc., Bothell, WA 98041-1023; 1987.

*Primary Examiner*—Glen R. Swann, III
*Assistant Examiner*—Thomas J. Mullen, Jr.

[57] ABSTRACT

A remote solar powered radio frequency transmitter assembly and radio receiving and signalling system to indicate delivery of mail. The transmitter means is powered by a rechargeable battery system which is normally recharged by solar cells located on the transmitter means housing. The transmitter means comprises an FM radio transmitter operating in the 49 Mhz band, with a signal strength sufficient for providing an alarm signal to receive at least 4,200 feet distant over unbroken terrain. Upon opening of the mailbox door approximately 30 degrees (30°), a switch initiates a six (6) second operation of the transmitter means. A receiver is provided to detect the radiated signal, and to energize visual and audible signals in response thereto. Ten position DIP switches are provided at both transmitter means and receiver to vary the frequency of operation so as to minimize or eliminate interfering signals. The transmitter means is secured to the mailbox by a single attachment post. A jack plug and flexible cord are provided to connect the transmitter means and the switch. The switch is provided with a flat backing plate having a double sided adhesive for ease of installation. The audible alarm at the receiver comprises a digitally generated musical tune. The musical tune automatically stops after about 20 seconds, unless the receiver is reset sooner. Reset of the receiver turns off both the musical tune audible alarm and the flashing light visual alarm.

19 Claims, 7 Drawing Sheets

FIG. 4D
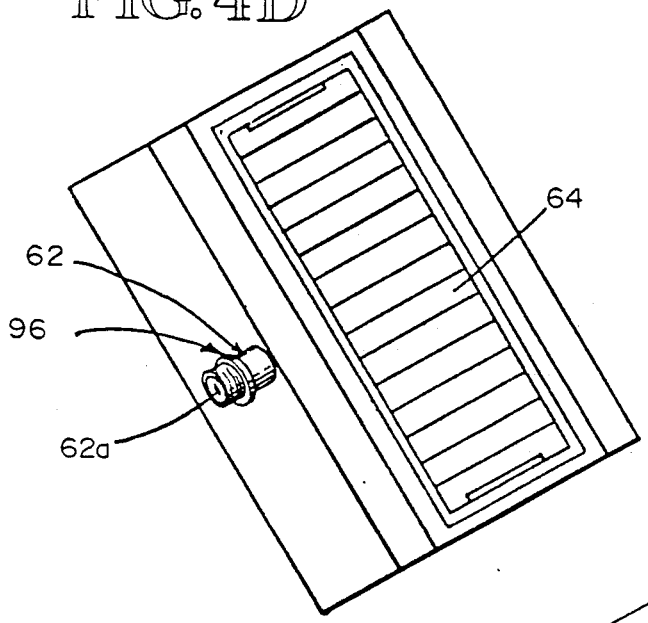
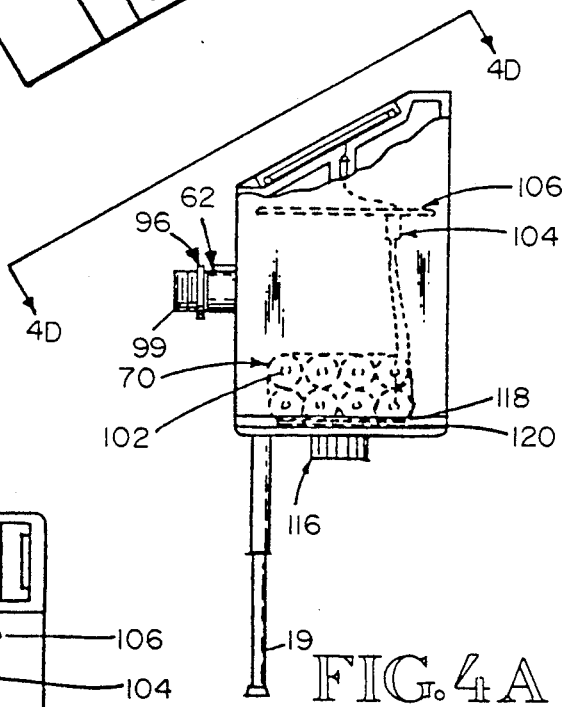
FIG. 4A
FIG. 4B
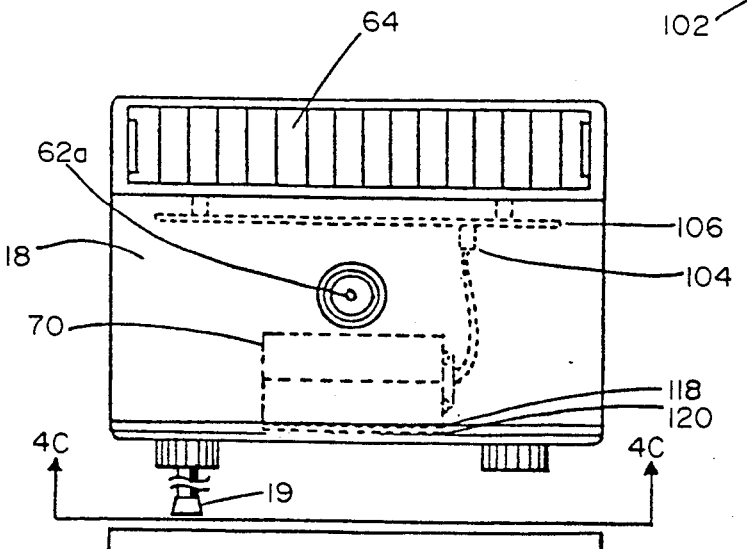
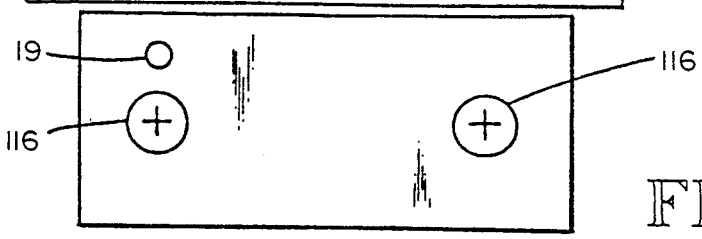
FIG. 4C

LAMP
30
SPK
28
RESET
84
10 POSITION DIP SWITCH
88
12V DC INPUT
122
74
82
86

MAIL ARRIVAL SIGNAL SYSTEM

TECHNICAL FIELD OF THE INVENTION

This invention relates to novel, improved apparatus which signals the arrival of mail to a mailbox. More particularly, the invention relates to a mail arrival signal system with improved signal reliability, which includes solar cells for transmitter battery recharge, and which includes features allowing quick installation.

BACKGROUND OF THE INVENTION

Mail security is of increasing concern to many individuals and businesses. To prevent theft of checks, such as U.S. social security checks, dividend checks, etc., or to prevent loss or disclosure of confidential business information, there is often an urgent need for individuals or businesses to be alerted when mail delivery occurs. A signal system is particularly desirable for those locations where it is difficult or impossible to view the mailbox. However, with a timely, reliable signal, prompt action can be taken to pick up a mail delivery. For those with a long or physically difficult trip to the mailbox, such a system is also particularly desirable.

In addition, security of property is also of increasing concern to many individuals or businesses. For instance, in many rural areas, it would be desirable to provide a warning signal when fence gates or building doors are opened, so that prompt action can be taken to secure the areas against theft of animals, machinery, or other property.

A number of devices for providing mail arrival signals have been identified. A search of the patent literature has disclosed various patents, as follows:

Canadian Patent No. 507,682, issued Nov. 30, 1954 to Bordner, describes an early battery powered signal unit for mailboxes. The unit evidently required periodic battery replacement The apparatus was quite bulky, and required numerous separate attachments for both the batteries and the transmitter. The upwardly extending antenna was also an easy target for vandals. Additionally, Bordner uses a pin-type activation switch, which is prone to adverse effects from wear and weather.

U.S. Pat. No. 3,611,333, issued Oct. 5, 1971 to Conigliaro, illustrates a battery powered signal transmitter and a remote receiver for use in indicating mail deposit The device evidently operates in the frequency range used by garage door openers. Thus, it is often subject to spurious triggering. A pin-type switch is also utilized, which is prone to failure due to adverse effects just described above.

U.S. Pat. No. 3,707,260, issued Dec. 26, 1972 to Gelineau, Sr. et al., illustrates a mailbox which includes a mechanism responsive to opening of the door to trigger a transmitter, which sends a signal to a receiver to provide notice of mail delivery. Gelineau's alarm system is not suitable for attachment to existing mailboxes; rather, this design is easily or economically practiced only by initial fabrication of a mailbox to incorporate the described actuator and switch mechanism.

U.S Pat. No. 4,287,514, issued Sept. 1, 1981 to Wartman et al., illustrates a signalling device for attachment to the bottom of an existing mailbox. The device is activated by the opening of the door against a pin-type switch, which is prone to failure. Also, attachment of the device in the field requires careful location of the switch.

U.S. Pat. No. 4,520,350, issued May 28, 1985 to Huang, illustrates a mailbox design which includes an end switch to detect door opening, and a transmitter to send a signal to a remote receiver and alarm system. The design is only appropriate for incorporation into newly manufactured boxes, and does not easily lend itself to retrofit of currently installed mailboxes. Also, the upwardly mounted antenna requires a mailbox roof penetration, subjecting it to potential moisture infiltration, as well as providing a convenient target for vandals.

U.S. Pat. No. 4,794,377, issued Dec. 27, 1988 to Benages, illustrates a mail signal system which is triggered by a photodiode Benages' device also suffers from the vertically mounted roof penetrating antenna. Also, this apparatus is not appropriate for existing mailboxes.

Another attempt at developing a mail alarm system is described in an installation manual for an electronic mail detector which was developed by Creative Technologies, Inc., in 1987. That device utilizes two infrared sensors. When the sensors are covered by arriving mail, an alarm signal is generated. However, the device is prone to rapidly depleting batteries, since the IR sensors check for mail approximately every five minutes.

Other types of alarm devices have been discovered in the patent literature, as follows:

U.S. Pat. No. 3,603,952, issued to Smith on Sept. 7, 1971, describes an oil spill sensor for remote locations The device utilizes solar cells for energy replenishment, and a radio telemetry circuit for sending an alarm signal.

U.S. Pat. No. 3,980,996, issued to Greenspan et al. on Sept. 14, 1976, describes a simple charging device for a battery powered radio-frequency alarm transmitter.

It is significant that the prior art identified above does not address a variety of details disclosed herein which are necessary to facilitate quick, inexpensive installation to existing mailboxes. In fact, many of the devices disclosed in the prior art references are considerably more complex than I consider desirable, especially from an installer or user's viewpoint. Neither have the prior art devices addressed radio frequency transmitter or receiving details which accomplish reliable operation over relatively long distances. Furthermore, none of the devices have included details such as a musical alarm in order to provide a less intrusive alarm. Finally, the prior art mailbox alarm systems of which we are aware do not disclose use of solar cells for replenishment of batteries I consider this item to be of paramount importance. The lack of solar cell designs which provide for a self-contained, internally rechargeable power supply in mailbox signal systems has heretofore been a significant drawback. Simple battery powered mail signal systems, without provisions for recharge, have allowed inadvertent security failures in prior art devices, particularly at those times when batteries fail.

SUMMARY OF THE INVENTION

In contrast to the various devices which have heretofore been utilized in an attempt to provide a serviceable mail arrival signal system, the novel mail arrival signal system disclosed herein provides a transmitter assembly which does not require an external power source or the periodic replacement of batteries. The present invention comprises a radio frequency transmitter assembly, including a transmitter means suitable for attachment to the rear of an existing conventional mailbox by a single attachment post, a switch means, a flexible cord, a cord housing and a jack plug. The transmitter means includes a solar cell panel to collect sunlight falling thereon, and to generate a direct current output voltage therefrom to charge the transmitter means power supply batteries. Transmitter means also includes an FM radio transmitter operating on the 49 Mhz band with a signal strength sufficient to provide an alarm signal to a remote receiver located up to 4,200 feet away. A switch means affixed to the mailbox door is responsive to the pivotable movement of the mailbox door. Preferably, the switch means is a mercury-type switch having a conductive liquid responsive to changes in orientation of the container of the conductive liquid, so that the transmitter means is activated when the door is opened outwardly by an angle Alpha ($\alpha$) of approximately 30°. The switch is provided in a molded one-piece case with a flat backing plate. A double-sided, self-sticking adhesive panel is applied to the flat backing plate to quickly affix the switch to the inside of the door. Also included to provide a quickly installable system for existing mailboxes is a flexible cord and jack plug to electrically connect the switch means to the transmitter means. Further, to protect the flexible cord from mail inserted into the mailbox, the flexible cord is routed through a cord housing.

Upon activation, the transmitter means radiates radio frequency energy from a downwardly extending antenna attached to the transmitter means housing. The transmitter means electrical circuit provides for a lock ed on transmit period of approximately six (6) seconds after it is triggered. A remote receiving and signalling assembly, usually located at an indoor location, detects the signal and provides an alarm indication. A receiving antenna detects the radiated signal and conducts it to a receiver. The receiver is responsive to the detected signal and provides alarms in response thereto An audible alarm in the form of a musical tune, and a visual alarm in the form of a flashing light are energized. The audible alarm musical tune terminates after 19 to 20 seconds. However, the visual alarm remains functional; both can be stopped at any time by depressing a reset button to de-energize the alarm circuits.

OBJECTS, FEATURES, AND ADVANTAGES OF THE INVENTION

With the above considerations in mind, it is an object of the present invention to provide a mail security signal device wherein:

(1) the remote transmitter does not require external power or frequent battery replacement;

(2) the receiver avoids false triggering;

(3) frequency adjustment is provided to avoid interference;

(4) both visual and audible alarm signals are provided.

(5) the audible alarm signal has a pleasing musical tune;

(6) installation may be easily accomplished in existing mailboxes.

Additional objectives, advantages, and novel features of our invention will be set forth in the DETAILED DESCRIPTION OF THE INVENTION which follows, or may become apparent to the reader from the appended claims and accompanying diagrams, or may be learned by practice of the invention. The objects and advantages of the invention may be realized and attained by means of the instrumentalities and combinations particularly pointed out in the appended claims.

BRIEF DESCRIPTION OF THE DRAWINGS

My invention may be more clearly understood by reference to the accompanying drawings thereof, wherein:

FIG. 2B is a detail of a portion of FIG. 2A, illustrating use of double sided adhesive for installation of an activation switch.

FIG. 2C is a detail of a switch means.

FIG. 4A is a side view of the transmitter means.

FIG. 4B is a front view of the transmitter means.

FIG. 4C is a bottom view of the transmitter means.

FIG. 4D is an oblique view of the transmitter means taken from the plane of the solar panels.

BRIEF DESCRIPTION OF THE TABLES

Table I is a parts list for the components depicted in the schematic of FIG. 6. Table II is a parts list for the components depicted for the receiver illustrated in FIGS. 7A and 7B.

DETAILED DESCRIPTION OF THE INVENTION

Figure 1:
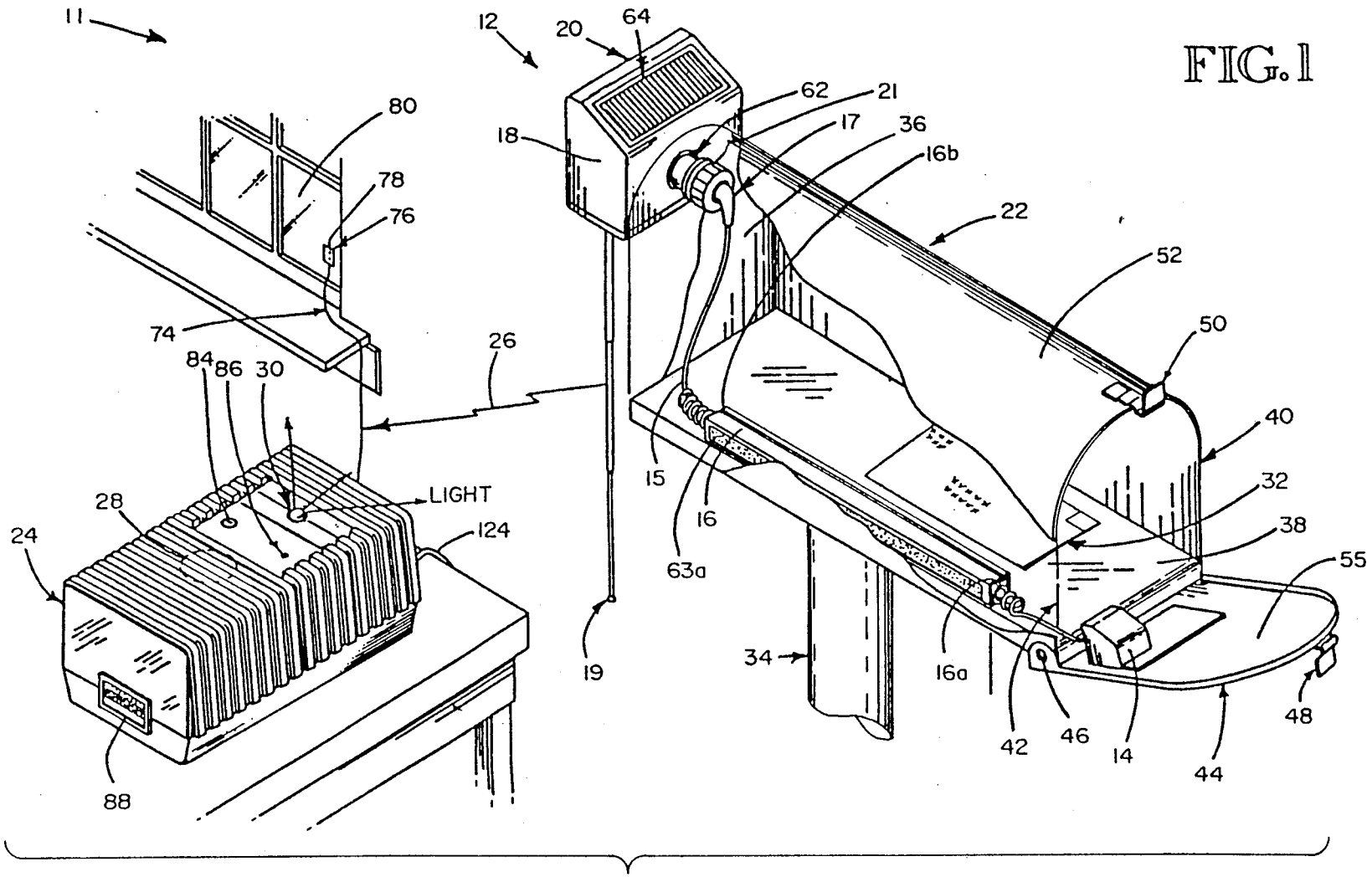
FIG. 1 is a perspective view showing the various components of the invention.

FIG. 1 illustrates the basic components of my mail arrival signal system 11. A transmitter assembly 12 is shown, comprising a switch means 14, a cord 15, a cord housing 16, a jack plug 17, a transmitter housing 18, an antenna 19, and a transmitter means 20. The solar powered transmitter means 20 is shown secured at the rear 21 of mailbox 22. A remotely located receiving and signalling assembly (or receiver) 24 is provided The receiver is responsive to radio frequency signals 26 which are radiated upon activation of transmitter means 20. The receiver includes both an audible alarm from speaker 28 and a visual alarm from light 30 to signal arrival of mail 32.

Turning again to FIG. 1, the mailbox 22 of conventional design is shown supported by post 34. Box 22 has a rear wall 36, a bottom 38, opposing sidewalls 40 and 42, and a front door 44. The front door is pivotedly mounted at pivot pin 46 so that it may swing open in a forward, outward, and downward direction, when the latch 48 is disengaged from a fixed catch 50 located on the top 52 of box 22.

Switch means 14 is shown mounted to the interior 55 of front door 44 Switch means 14 is preferably a mercury type switch or a comparable design which is activated upon opening of door 44 by an angle Alpha ($\alpha$) of less than 45°, normally between 20° and 40°, and preferably by an angle of 30°. Shown in FIG. 2C is one suitable configuration of switch means 14. An electrically conductive liquid 58, such as mercury, is provided in a suitable container 59. The container 59 has electrical contacts 60*a* and 60*b* at suitable locations in the container 59. When the container 59 is angularly displaced, the conductive liquid 58 moves from an open position (not shown) to a closed, conductive position 63, wherein the conductive liquid 58 completes an electrical circuit between electrical contacts 60*a* and 60*b*.

A flexible cord 15 of variable length extends from switch means 14, through cord housing 16, and on to jack plug 17. The jack plug 17 is connected to attachment post 62.

Attachment post 62 serves as a single mounting point on mailbox 22 for transmitter means 20, and internally provides an electrical connection or jack receptacle 62*a* between jack plug 17 and transmitter means 20. Attachment post 62 is inserted through aperture 61 in the rear 36 of box 22. The aperture 61 is the only installation item which requires any tools; here, a punch or drill is required to create an adequately sized aperture 61 for attachment post 62. This is important since minimizing retrofit installation requirements is a primary and important feature of my invention.

Use of jack plug 17 and flexible cord 15 are important because they allow quick connection between switch means 14 and transmitter means 20 for various length mailboxes 22. A 90° bend, as illustrated, is a preferable configuration for jack plug 17, to avoid interference or damage by mail 32. Cord housing 16 is furnished with a double-sided, self-sticking adhesive panel 63*a* (including a protective strip for peel off at installation, not shown) which is employed to anchor cord housing 58 at a suitable location against the bottom 38 or sidewalls 40 or 42 of mailbox 22. Cord housing 16 protects flexible cord 15 against damage from mail 32. Cord housing 16 has a front opening 16*a*, a rear opening 16*b*, and an open chamber 16*c* (shown in FIG. 2) therebetween for receiving and protecting flexible cord 15.

Located behind the rear wall 36 of mailbox 22 is transmitter means 20. Transmitter means 20 has solar cells 64 situated to collect solar radiation 66 from sun 68. These solar cells 64 are for the purpose of recharging battery pack 70 (shown in FIG. 4A) which provides power to transmitter means 20. As may be seen more clearly in FIG. 2, solar cells 64 are affixed to housing 18 of transmitter means 20 at an angle Beta ($\beta$) which can be provided at time of manufacture to suit a particular locale or installation orientation, in order to maximize collection of available light. A suitable angle Beta ($\beta$) is normally 45°, however Beta ($\beta$) may range from 30° to 60°.

Attached to transmitter housing 18 at the bottom of transmitter means 20, a downwardly extending antenna 19 is provided to radiate radio frequency energy 26. The downward extending antenna 19 is located in a protected position behind post 34, where it is not easily reached by vandals. Similarly, transmitter housing 18 is ideally located so that only solar cells 64 are visible above the top 52 of mailbox 22.

At a remote location, receiving antenna 74 detects the radio frequency energy 26 and conducts that signal to receiver 24. Antenna 74 may be provided with an adhesive patch 76 at its distal end 78 so that receiving antenna 74 may be conveniently located at a desirable location to improve radio frequency reception, such as window 80.

Receiver 24 contains a visual alarm 30 (i.e., light) and an audible alarm which may be from a speaker 28 (shown schematically in FIG. 8) which generates an electronically generated musical tune 82. The receiver 24 is also equipped with a reset button 84, and a power indicating light 86. As will later be discussed in detail, while the musical tune 82 from speaker 28 is normally de-energized after approximately twenty (20) seconds, the visual alarm 30 will remain energized until reset by means of reset button 84.

To reduce or eliminate interference between multiple systems in the same proximity, a 10-position DIP switch 88 is provided at the receiver 24, and a similar 10-position DIP switch 90 (shown in FIG. 6) is provided at the transmitter, for small tuning adjustments to a desired radio frequency.

Figure 2A:
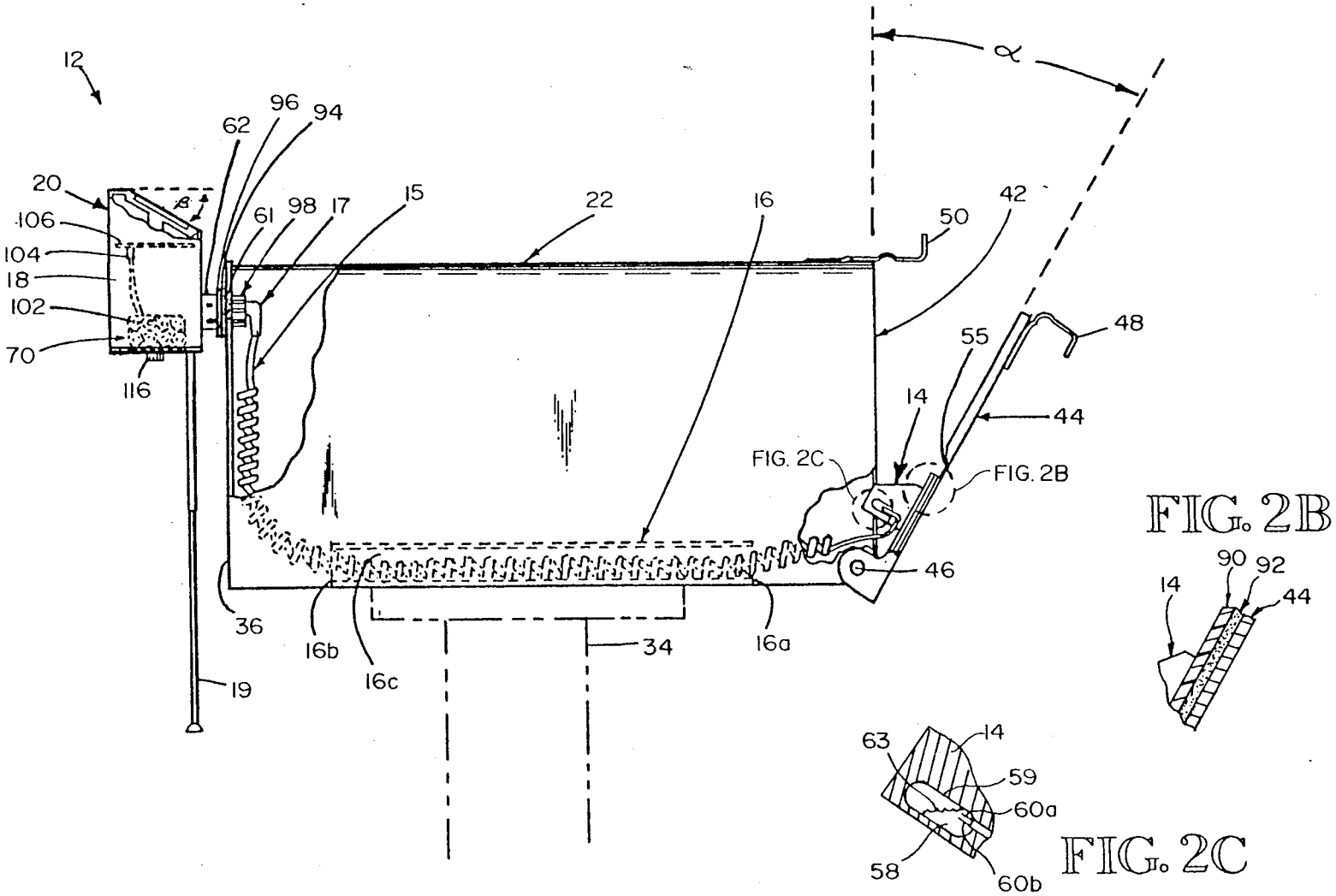
FIG. 2A is a side view of a mailbox illustrating the activating and transmitting components of my invention.

Attention is now directed to FIGS. 2A and 2B. Switch means 14 is shown mounted to door 44. A flat mounting plate 90 is provided as an integral part of switch means 14. A double sided adhesive strip 92 is provided between mounting plate 90 and inside 55 of door 44. This mounting procedure utilizing a double sided adhesive strip 92 is important because it allows quick field installation of switch means 14; similarly, adhesive strip 62 allows quick installation of cord housing 16.

Attachment post 62 is inserted through an aperture 61 in rear wall 36 of mailbox 22. A compressible washer 94, preferably ultraviolet light resistant elastomer, provides a weather-tight seal between a mounting shoulder 96 on attachment post 62 (shown in FIG. 4A), and rear wall 36 of box 22.

A knurl nob 98 is provided, which is secured on threads 99 on attachment post 62 as seen in FIG. 4A.

Referring to FIGS. 4A and B, a battery pack 70, comprised of eight 1.2 volt Ni-Cad batteries 102 is shown in hidden lines within transmitter means 20. A power lead 104 connects battery pack 70 with printed circuit board 106.

Also illustrated in FIGS. 4B and 4D, are a velcro pad 118 affixed to the bottom of battery pack 70, and a complementary velcro pad 120 affixed to the upper surface of mounting plate 110, which together serve to secure battery pack 70 in transmitter means 20.

Figure 3B:
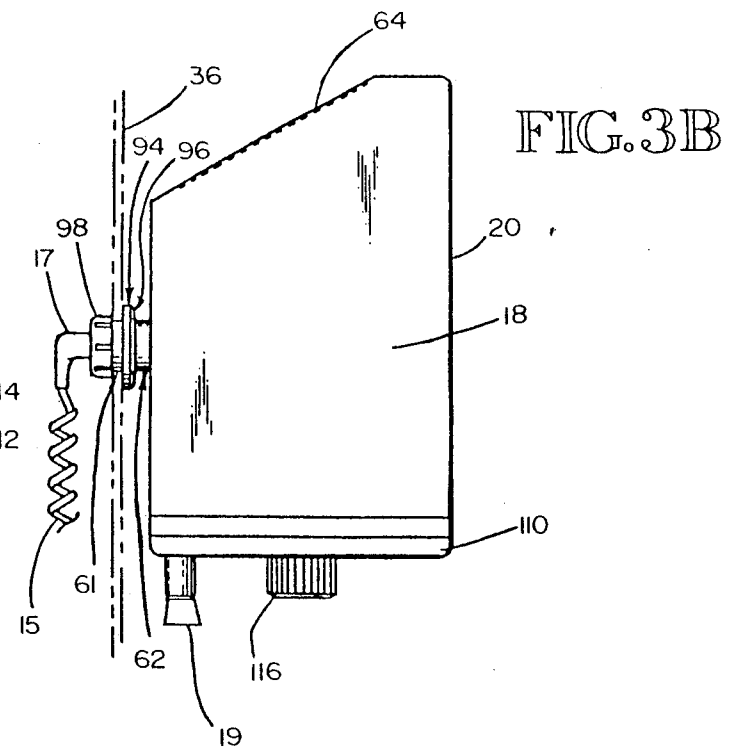
FIG. 3B is a side view of the transmitter means showing the attachment of same to the rear of a mailbox.
Figure 3A:
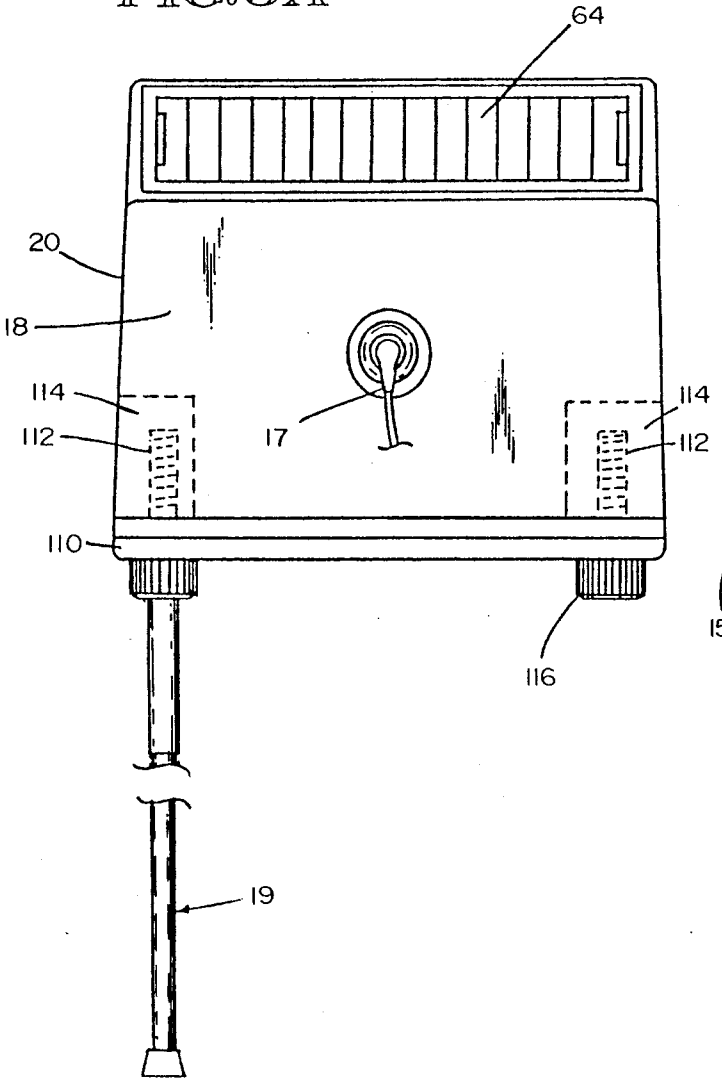
FIG. 3A is an end view of the external of the radio frequency transmitter means disclosed herein.

Turning now to FIGS. 3A and 3B, a bottom plate 110 is shown secured to transmitter housing 18. A threaded bolt 112 is inserted into a matching threaded housing 114 to fasten bottom plate 110 in place. Bolt 112 may be provided with a knurl type nut 116 so that it may be easily tightened by hand.

Figure 5A:
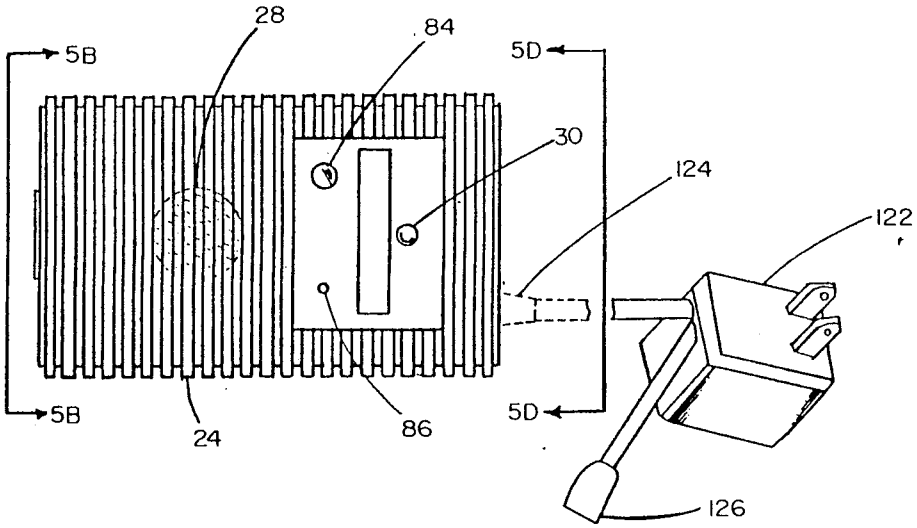
FIG. 5A is a top view or the receiver and a perspective view of a power transformer.

Turning now to FIG. 5A, the receiver 24 is illustrated A DC power supply transformer 122, suitable for use with any standard 110 volt power supply is shown. The power supply transformer 122 provides direct current input to receiver 24 via power cord 124. Receiver 24 is provided with a power jack 125 which receives plug 124. Once unique feature is the provision of a second power cord plug 126 with transformer 122. Plug 126 is sized so that it may mate with power plug 104 of the battery pack, and can be used to make an initial charge of battery pack 70.

Figure 5B:
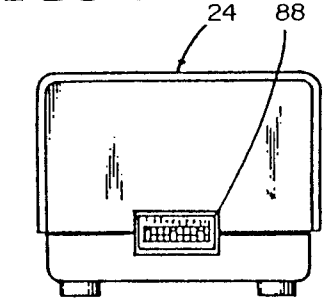
FIG. 5B is a rear end view of the receiver.
Figure 5C:
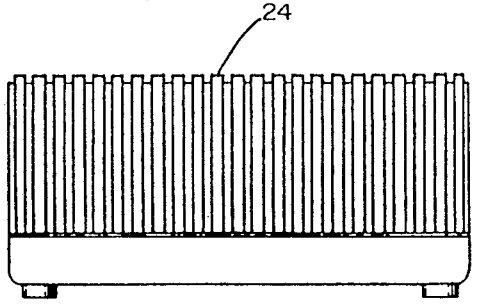
FIG. 5C is a side view of the receiver.
Figure 5D:
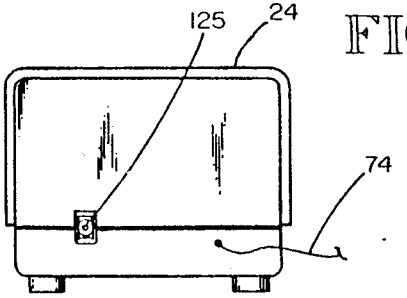
FIG. 5D is a front end view of the receiver.

Shown in FIG. 5B is the 10-position DIP switch 88 which may be used to adjust the frequency of reception of receiver 24.

Figure 6A:
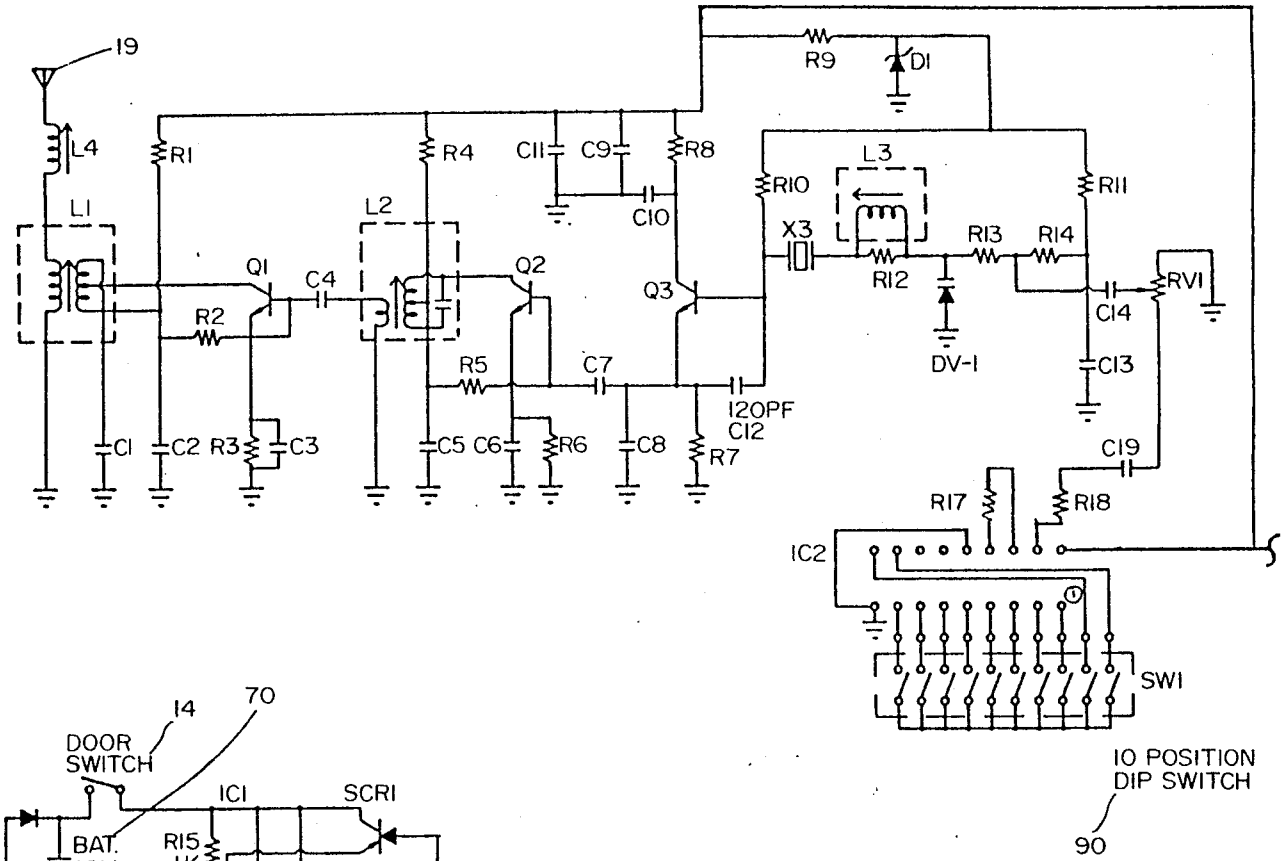
FIG. 6 shows the relationship among FIGS. 6A–6B which, taken together, constitute an electrical schematic illustrating the transmitter means utilized in the present invention.

Attention is now directed to the electrical schematic of FIGS. 6A and B, which depict the electronic operation of transmitter means 20. When transmitter means 20 is not energized, solar cells 64 provide a direct current input to the direct current storage means, battery pack 70. Solar cell 64 may be comprised of an array of one-in-series by one-in-parallel model G-100 solar cell modules as manufactured by Arco Solar Company that model specifying a thin film monolithic silicon:hydrogen alloy solar cell uniquely suitable for this application.

When door 44 is opened, switch 14 completes an electrical circuit, allowing electrical current from battery pack 70 to energize transmitter means 20. Upon power input to transmitter means 20, oscillator circuit L3 is energized at a frequency controlled by crystal X3. Amplifier circuits L2-Q1, assisted by related components identified in the figures, provide a radio signal for radiation via antenna 72. One frequency range which has been found advantageous is the 49 Mhz band, however, the unit may be utilized anywhere in the 26 to 56 Mhz range. The transmitter means radiates sufficient power to reliably alert the signal receiver 24 when located at least 4,200 feet away over unbroken terrain. The exact broadcast frequency may be slightly adjusted via means of 10-position DIP switch 90, so as to avoid interference, for example, from other mail arrival signal systems.

Frequency modulation type (FM) transmitter operation was chosen to obtain a high signal to noise ratio, and to avoid the potential interference of garage door openers, which typically operate at other frequencies which heretofore have been used, with some difficulty, for mail signal systems.

Figure 6B:
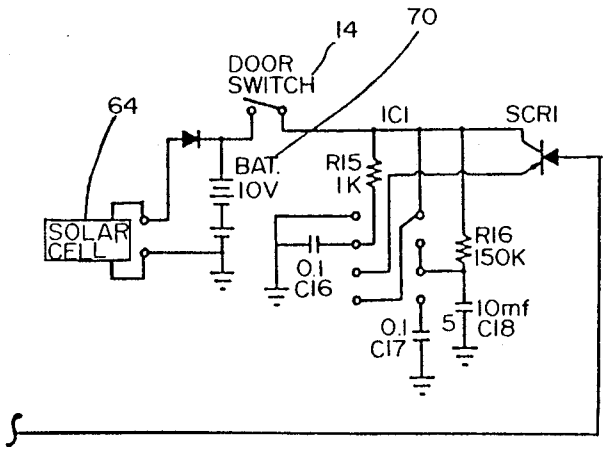

Transmitter means 20 is provided with an approximately six (6) second latched broadcast time period after closure of switch 14. After passage of the selected time of six (6) seconds, it would be necessary to re-open door 44 to close contacts of switch 14 to re-energize the transmitter means 20. A complete description of each of the electronic parts identified in FIGS. 6A and 6B is included in the parts list of Table I.

Figures 7A, 7B:
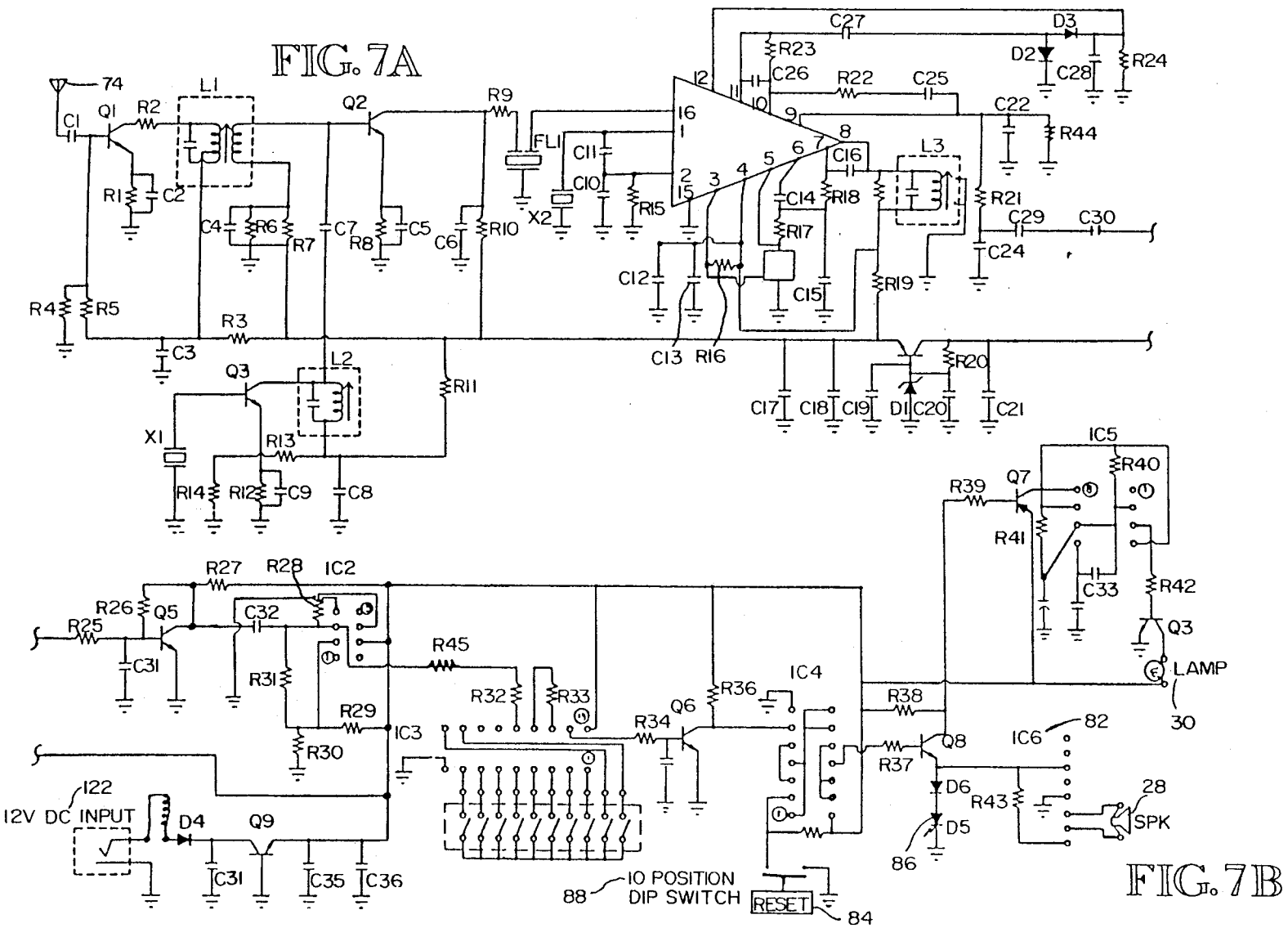
FIG. 7 shows the relationship among FIGS. 7A–7B which, taken together, constitute an electrical schematic illustrating the receiver utilized in the present invention.

The receiver 24 is described in the electrical schematics of FIGS. 7A and 7B. Direct current power input is provided by transformer 122. It is necessary to provide electrical power at all times to receiver 24, so that it is ready to receive any signal radiated from transmitter means 20. To provide an indication that the receiver 24 is energized, a red light emitting diode 86 (part D5) is provided, which signals an "on" condition when illuminated.

It is necessary that the 10-position DIP switch 88 be adjusted to the corresponding position of the 10-position DIP switch 90 of transmitter means 20, so that the transmitter means 20 and receiver 24 are operating on an identical frequency.

When a radio frequency signal 26 is radiated from transmitter means 20 via antenna 72, the signal 26 is detected by the receiving antenna 74. The detected signal is amplified by the basic radio frequency amplifier circuitry Q1-L1. Oscillator circuits Q3-L3 and related components provide a signal which is mixed with the output from the basic radio frequency amplifier The mixed signals are then frequency filtered through crystal FL1, coupled with Q2 and integrated circuit 1L1. Zener diode D1 acts as a voltage regulator with Q4, thereby regulating current to Q1, Q2, and 1C1. The tuned amplified output of 1C1 is provided to trigger operation of a visual alarm, flashing lamp 30. Output to digital audio amplifier item IC6 generates a musical tune 82 via speaker 28. The digital audio unit IC6 completes a musical tune 82 output cycle in 19 to 20 seconds. At that time, the audible signal 28 ceases. If desired by the user, depressing reset button 84 will stop emission of the musical tune 82 at any time. The addition of a musical alarm 82 is an important feature which makes my novel device less intrusive than the heretofore utilized buzzers, bells, and the like. Depressing reset button 84 also will turn off operation of lamp 30.

The specific electronic part items identified in FIGS. 7A and 7B are described in Table I.

The foregoing description of a representative embodiment of the invention has been presented only for purposes of illustration and description and for providing an understanding of the invention. It is not intended to be exhaustive or limit the invention to the precise form disclosed. On the contrary, the intention is to cover all modifications, equivalents, and alternatives falling within the spirit and scope of the invention as expressed in the appended claims. It is therefore that the intended scope of the invention be defined by the appended claims rather than by the foregoing description; and all changes which come within the meaning and range of equivalency of the claims are therefore intended to be embraced therein.

What is claimed is:

1. An automatic system for signalling arrival of mail, said signal system for use with a mailbox of a type comprised of an elongated container having a bottom, sidewalls, a rear end, and an open end, said open end having attached thereto a door, said door being outwardly pivotable, manually movable, and normally closed, said signal system comprising in combination:

(a) a transmitter assembly for placement at said mailbox, comprising:

(i) radio-frequency transmitter means, said transmitter means including high efficiency thin film solar cells, said solar cells adapted to collect sunlight falling thereon and to generate a direct-current output therefrom, said transmitter means also including direct-current storage means adapted to receive said direct current output from said solar cells and to store electrical energy in response thereto; and (ii) a transmitter housing adapted to enclose said transmitter means; and (iii) switch means internally mounted on said floor, said switch means electrically connected to said transmitter means, said switch means responsive to angular displacement of said door by an angle Alpha ($\alpha$), said response of said switch means operating to trigger emission of a radio frequency signal by said transmitter means; and (b) a receiving and signalling assembly for placement at a remote location, said assembly comprising:

(i) a receiving antenna, said receiving antenna adapted to detect said radio frequency signal radiated by said transmitter means, and (ii) a radio-frequency receiver, said receiver tuned to receive said signal radiated by said transmitter means and detected by said receiving antenna means, said receiver further including an alarm means, said alarm means responsive to signals received by said receiver to provide a signal indicating the arrival of mail.

2. The apparatus of claim 1, wherein said switch means is operatively connected to said transmitter means by a flexible multi-conductor cord, said flexible multi-conductor cord having a switch end and a transmitter end, wherein said multi-conductor cord is protected by a cord housing.

3. The apparatus of claim 1, wherein said transmitter means is energized to transmit a radio frequency signal for four to eight seconds upon electrical closure of said switch.

4. The apparatus of claim 1, wherein said receiver is provided with a power supply transformer having a power supply lead and a second power supply lead, said first mentioned power supply lead supplying electrical power for said receiver, and said second lead providing direct current electrical power to charge said battery means.

5. The apparatus of claim 1, wherein said flexible receiving antenna has a distal end, said distal end being provided with an adhesive patch, said adhesive patch configured to allow manual attachment of said patch to a desirable operational location to secure said distal antenna end to improve radio frequency signal reception.

6. The apparatus of claim 1, wherein said transmitter housing includes a single manually secureable attachment post, whereby said transmitter housing may be securely affixed to said mailbox.

7. The apparatus of claim 6, wherein said attachment post further includes a jack receptacle, said jack receptacle configured to receive a jack plug, said jack plug operatively connected to a flexible multi-conductor cord, wherein said transmitter means may be quickly attached to said multi-conductor cord so as to provide an operable connection to said switch.

8. The apparatus of claim 1, wherein said switch means is a mercury switch.

9. The apparatus of claim 8, wherein said switch means is situated on said door at an operative position which allows said switch to make an electrical connection to energize said transmitter means when said door is opened by a displacement angle Alpha ($\alpha$) of less than 45°.

10. The apparatus of claim 8, wherein said switch means is situated on said door at an operative position which allows said switch to make an electrical connection to energize said transmitter means when said door is opened by a displacement angle Alpha ($\alpha$) between 20° and 40°.

11. The apparatus of claim 8, wherein said switch means is situated on said door at an operative position which allows said switch to make an electrical connection to energize said transmitter means when said door is opened by a displacement angle Alpha ($\alpha$) of 30°.

12. The apparatus of claim 1, wherein said switch means is located in a water resistant housing, said housing having a flat mounting plate.

13. The apparatus of claim 12, wherein said flat mounting plate includes an adhesive panel, whereby said switch may be quickly and securely affixed to said door.

14. The apparatus of claim 1, wherein said signal radiated by said transmitter means may be received by said receiver at a line of sight distance of up to 4,200 feet.

15. The combination of a mail receiving container and a system for signalling the arrival of mail to said container, said system including:

(a) a mailbox of a type comprised of an elongated container having a bottom, sidewalls, a rear end, and an open end, said open end having attached thereto a door, said door being outwardly pivotable, manually movable, and normally closed; and (b) a transmitter assembly for placement at the rear of said mailbox, comprising:

(i) radio-frequency transmitter means, said transmitter means including high efficiency thin film solar cells, said solar cells adapted to collect sunlight falling thereon and to generate a direct-current output therefrom, said transmitter means also including direct-current storage means adapted to receive said direct current output from said solar cells and to store electrical energy in response thereto; and (ii) a transmitter housing adapted to enclose said transmitter means; and (iii) a switch means, said switch means electrically connected to said transmitter means, said switch means responsive to angular displacement of said door by an angle Alpha ($\alpha$), said response of said switch means operating to trigger emission of a radio signal by said transmitter means; and (c) a receiving and signalling assembly for placement at a remote location, said assembly comprising:

(i) a receiving antenna means, said receiving antenna means adapted to detect said radio frequency signal radiated by said transmitter means; and (ii) a radio-frequency receiver, said receiver tuned to receive said signal radiated by said transmitter means and detected by said receiving antenna means, said alarm means responsive to signals received by said receiver to provide a signal indicating the opening of said door, thereby indicating the arrival of mail.

16. An automatic system for signalling arrival of mail, said signal system for use with a mailbox of a type comprised of an elongated container having a bottom, sidewalls, a rear end, and an open end, said open end having attached thereto a door, said door being outwardly pivotable, manually movable, and normally closed, said signal system comprising:

(a) a transmitter assembly for placement at said mailbox, comprising:

(i) radio-frequency transmitter means, said transmitter means including high efficiency thin film solar cells, said solar cells adapted to collect sunlight falling thereon and to generate a direct-current output therefrom, said transmitter means also including direct-current storage means adapted to receive said direct current output from said solar cells and to store electrical energy in response thereto; and (ii) a transmitter housing adapted to enclose said transmitter means; and (iii) a switch means internally mounted on said door, said switch means electrically connected to said transmitter means, said switch means responsive to angular displacement of said door by an angle Alpha ($\alpha$), said response of said switch means operating to trigger emission of a radio frequency signal by said transmitter means; and (b) a receiving and signalling assembly for placement at a remote location, said assembly comprising:

(i) a receiving antenna means, said receiving antenna means adapted to detect said radio frequency signal radiated by said transmitter means; and (ii) a radio-frequency receiver, said receiver tuned to receive said signal radiated by said transmitter means and detected by said receiving antenna means, said receiver further including an alarm means, said alarm means responsive to signals received by said receiver to provide a signal indicating the opening of said door, thereby indicating the arrival of mail.

17. The apparatus of claim 16, wherein said transmitter means is energized to transmit a radio frequency signal for four to eight seconds upon electrical closure of said switch.

18. The apparatus of claim 16, wherein said receiver is provided with a power supply transformer having a power supply lead and a second power supply lead, said first mentioned power supply lead supplying electrical power for said receiver, and said second lead providing direct current electrical power to charge said battery means.

19. The apparatus of claim 16, wherein said switch means is located in a water resistant housing, said housing having a flat mounting plate.

* * * * *